United States Patent [19]

Uda et al.

[11] 4,376,740

[45] Mar. 15, 1983

[54] PROCESS FOR PRODUCTION FINE METAL PARTICLES

[75] Inventors: Masahiro Uda, Tokyo; Satoru Ohno, Kiyose; Tsutomu Hoshi, Kodaira, all of Japan

[73] Assignee: National Research Institute for Metals, Tokyo, Japan

[21] Appl. No.: 222,903

[22] Filed: Jan. 5, 1981

[51] Int. Cl.[3] ..... B01J 2/04

[52] U.S. Cl. ..... 264/10; 264/12; 264/82

[58] Field of Search ..... 264/10, 12, 82

[56] References Cited

U.S. PATENT DOCUMENTS

| | | | |
|---|---|---|---|
| 3,275,787 | 9/1966 | Newberry | 264/10 |
| 4,009,233 | 2/1977 | Cloran et al. | 264/10 |
| 4,238,427 | 12/1980 | Chisholm | 264/10 |

*Primary Examiner*—James R. Hall

*Attorney, Agent, or Firm*—Wenderoth, Lind & Ponack

[57] ABSTRACT

A process for producing fine particles of a metal or alloy, which comprises contacting a molten metal or alloy with activated hydrogen gas thereby to release fine particles of the metal or alloy having a diameter of less than 10 microns from the molten metal or alloy.

4 Claims, 5 Drawing Figures

PROCESS FOR PRODUCTION FINE METAL PARTICLES

This invention relates to a process for producing fine metal particles having a diameter of less than 10 microns.

A process for producing very fine metal particles having a diameter of less than 10 microns has previously been known which comprises evaporating a metal in vacuum or in an inert gas under reduced pressure (to be referred to as the evaporating process) (Japanese Journal of Applied Physics, 8, No. 5, pp 551–558, May 1969). In the evaporating process, the rate of evaporation is determined by the temperature of the metal, the pressure of the atmosphere, etc., and its ability to produce fine metal particles is extremely low. In particular, it is difficult to produce fine particles of high-melting metals such as Nb and Ta by this process. With any given alloy, its melt has a different composition from its vapor, and it is frequently difficult to obtain fine alloy particles of the desired composition by the evaporating process. The evaporating process also has the defect of requiring a power supply source, an exhausting device, etc. of large capacity.

It is an object of this invention therefore to overcome the defects of the prior art, and to provide a process for producing fine particles of a pure metal or an alloy having a diameter of less than 10 microns with high efficiency in a small-sized device.

We have made extensive investigations in order to achieve the above object, and found that when a molten metal or a molten alloy is contacted with hydrogen gas which has been activated by heating it to a high temperature of at least 2,500° C. using discharge arc or plasma, fine particles of the metal or alloy having a diameter of less than 10 microns are released from the molten metal or alloy.

According to this invention, there is provided a process for producing fine particles of a metal or alloy. This process comprises contacting a molten metal or alloy with activated hydrogen gas thereby to release fine particles of the metal or alloy having a diameter of less than 10 microns from the molten metal or alloy.

As a source of generating the activated hydrogen gas, hydrogen gas and a compound in which the number of hydrogen atoms consisting the compound is at least two times the number of another element in the compound may be used. Examples are ammonia or a hydrocarbon such as methane, ethane, propane or ethylene.

As is well known, when a high-temperature plasma such as an arc discharge, a low-temperature plasma such as glow discharge, infrared rays, etc. are caused to act on hydrogen gas or the aforesaid hydrogen-containing compound, it produces activated hydrogen gas excited to atomic hydrogen or to a higher energy level, for example, to the state of a hydrogen ion.

The aforesaid compounds as sources of the activated hydrogen may be diluted with rare gases which are elements of Group O of the periodic table, i.e. helium, neon, argon, krypton, xenon and radon. However, the hydrogen concentration (when a compound other than hydrogen is used, this is calculated as the theoretical amount of hydrogen) must be maintained at 20% by volume or higher, and the hydrogen source should not be diluted to a lower concentration. When a hydrogen-containing compound is used, the hydrogen concentration is calculated as the theoretical amount of hydrogen generated. If the concentration of hydrogen gas in the gaseous mixture is less than 20% by volume, the rate of forming fine particles of metal or alloy becomes markedly low, and the object of this invention cannot be achieved.

The rate of forming fine metal or alloy particles increases with increasing hydrogen gas concentration in the gaseous mixture. Nevertheless, it is sometimes desirable to use the hydrogen gas after suitably diluting it with the aforesaid rare gas in view of the operability in the production of fine particles, for example the ease of arc generation. Usually, argon and helium are used. Examples of preferred gaseous mixtures are $H_2$-Ar (1:1), $H_2$-He (1:1), $H_2$-Ar-He (2:1:1), $CH_4$-Ar (1:3), $CH_4$-He (1:3), $C_2H_6$-Ar (1:3), $C_2H_6$-He (1:3), and $C_3H_8$-Ar (1:3).

The types of the metal and alloy which can be converted to fine particles by the process of this invention are not particularly critical, and any metals and alloys can be used. The process of this invention is especially effective for production of fine particles of high-melting metals which are difficult to reduce to fine particles by the evaporating process.

The metal or alloy may be melted by direct melting with arc, plasma, etc. used to activate hydrogen or the hydrogen-containing compounds, or by melting from other heat sources, for example by high frequency induction heating. It is necessary that the temperature of the molten bath be high enough to maintain the metal or alloy in the molten state; otherwise, no particular restriction is imposed on the melting temperature. If desired, only a part of the metal or alloy may be melted.

Contacting the molten metal or alloy with the activated hydrogen gas can be effected by methods which ensure reaction between them, for example blowing the activated gas against the surface of the molten metal or melting the metal or alloy in an atmosphere of the activated gas.

FIGS. 1 to 7 of the accompanying drawings are electron micrographs of fine metal particles produced by the process of this invention.

FIGS. 1 to 7 show that the fine metal particles have a maximum diameter of less than 10 microns, although the maximum diameter differs according to the type of metal.

Figure 8:
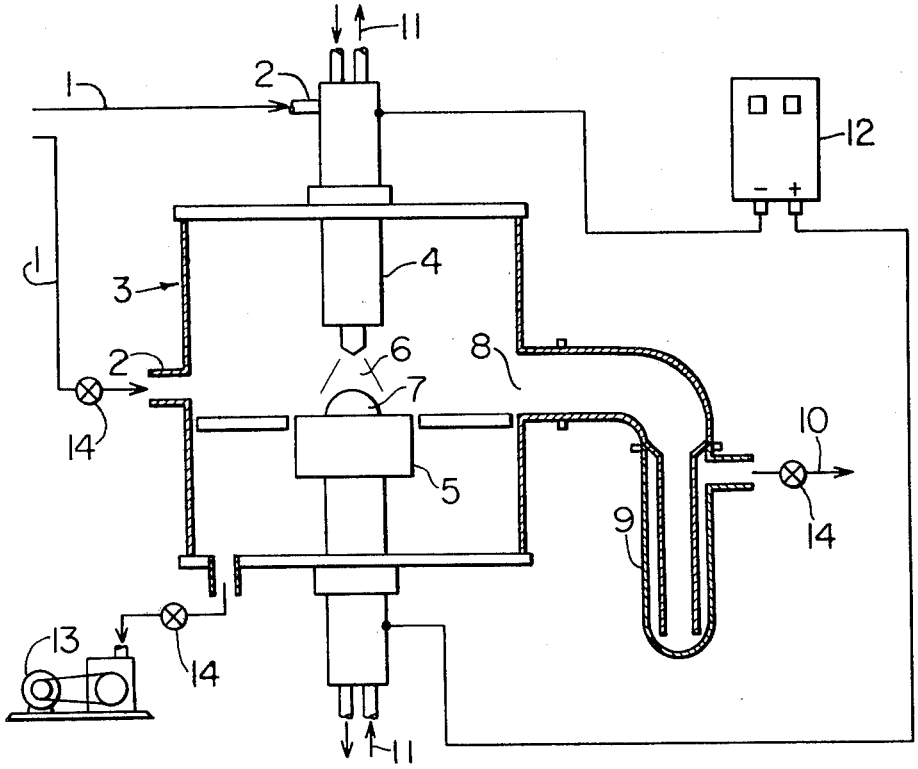

FIG. 8 of the accompanying drawings is a schematic view showing one embodiment of the arrangement of a device for performing the process of this invention.

Referring to FIG. 8, a gas source for generating activated hydrogen, for example hydrogen gas, is fed through lines 1 to a chamber 3 for producing fine metal particles via a gas feed ports 2. Within the chamber 3 are provided an arc-generating water-cooled electrode 4 and an opposing water-cooled copper mold 5. A direct-current voltage is applied across the electrode 4 and the mold 5 to generate an arc 6. A metal 7 on the mold 5 is melted, and hydrogen gas introduced into the chamber and present in the vicinity of the surface of the molten metal is activated by the heat of the arc and makes contact with the molten metal. Consequently, fine particles of the metal are released into the atmosphere from the surface of the molten metal. The hydrogen gas introduced continuously into the chamber 3 is continuously sent out of the chamber 3 from a gas discharge port 8 while carrying the released fine metal particles. The metal particles are separated by a trap 9, and go out of the device via a line 10. In this manner, fine metal particles having a diameter of less than 10 microns can be recovered from the trap 9.

The reference numeral 11 represents cooling water for cooling the electrode 4 and the mold 5, and the reference numeral 12 represents a direct-current power source for generating the arc.

It is preferred to evacuate the inside of the chamber by a vacuum pump 13 prior to feeding hydrogen gas into the chamber 3.

The reference numeral 14 represents valves.

According to the process of this invention described hereinabove, the device can be simplified in comparison with the prior art, and the ability of the process to produce fine metal particles is high. The process of this invention brings about an excellent effect of readily producing fine metal particles having a diameter of less than 10 microns.

The following Examples illustrate the present invention more specifically.

EXAMPLE 1

Fine iron particles were produced by a device of the type shown in FIG. 8. An arc was generated at a direct-current arc output of 180 amps and 15–25 volts under an atmospheric pressure of 1 atmosphere using a gaseous mixture of hydrogen and argon having a specified hydrogen concentration as a source of active hydrogen. Melting of iron and activation of the hydrogen gas were effected by direct heating with the heat of the arc.

Figure 1:
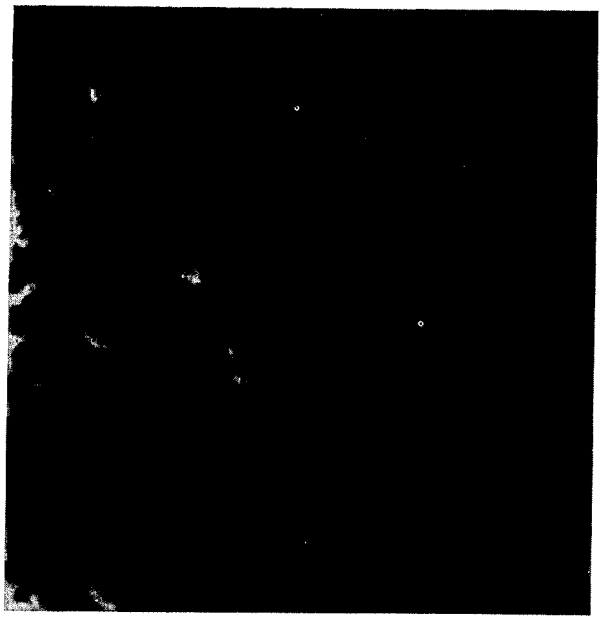
FIG. 1 is a scanning electron micrograph (10,000 X) of fine particles of iron.

The results are shown in Table 1. A scanning electron micrograph (10,000 X ) of the resulting fine metal particles is shown in FIG. 1.

Table 1 also shows the calculated rate of generating fine particles (the maximum rate of evaporation from an evaporating surface corresponding to about 3cm$^2$ of the surface of the molten metal in the above Example) by a conventional method (vacuum evaporating method). Also for comparison, Table 1 shows an example (Run No. 1) in which a gaseous mixture having a hydrogen concentration of less than 20% was used.

TABLE 1

| Run No. | Atmosphere | Rate of generating fine metal particles (g/hr) | Size of the fine particles (microns) | Rate of generating fine particles by the evaporating method |
|---|---|---|---|---|
| 1 | 15% $H_2$—Ar | 6 | | |
| 2 | 30% $H_2$—Ar | 30–90 | less than | 17.6 g/hr |
| 3 | 40% $H_2$—Ar | 180–240 | 2 | (2000 K) |

EXAMPLE 2

Figure 2:
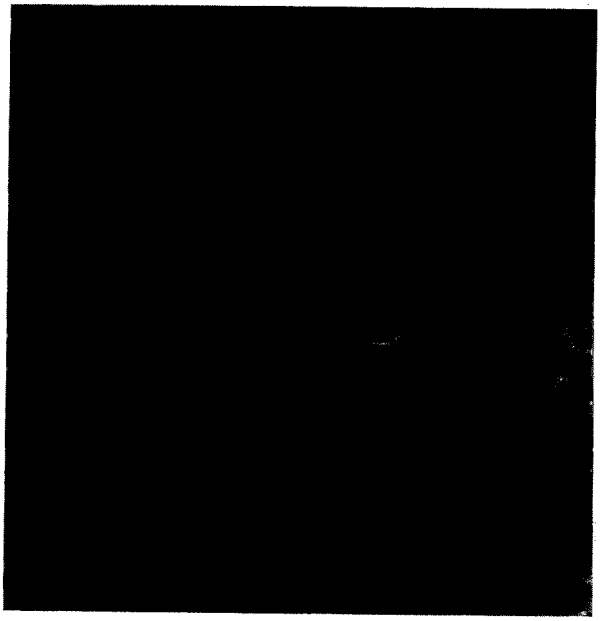
FIG. 2 is a scanning electron micrograph (10,000 X) of fine particles of cobalt.

Fine cobalt particles were produced in the same way as in Example 1 except that cobalt was used instead of iron. The results are shown in Table 2, and a scanning electron micrograph (10,000 X) of the resulting fine cobalt particles obtained in Run No. 5 is shown in FIG. 2.

TABLE 2

| Run No. | Atmosphere | Rate of generating fine metal particles (g/hr) | Size of the fine particles (microns) | Rate of generating fine particles by the evaporating method |
|---|---|---|---|---|
| 4 | 10% $H_2$—Ar | 0.5 | | |
| 5 | 15% $H_2$—Ar | 3 | less than | 11.9 g/hr |
| 6 | 50% $H_2$—Ar | 50–60 | 2 | (2000 K) |

EXAMPLE 3

Figure 3:
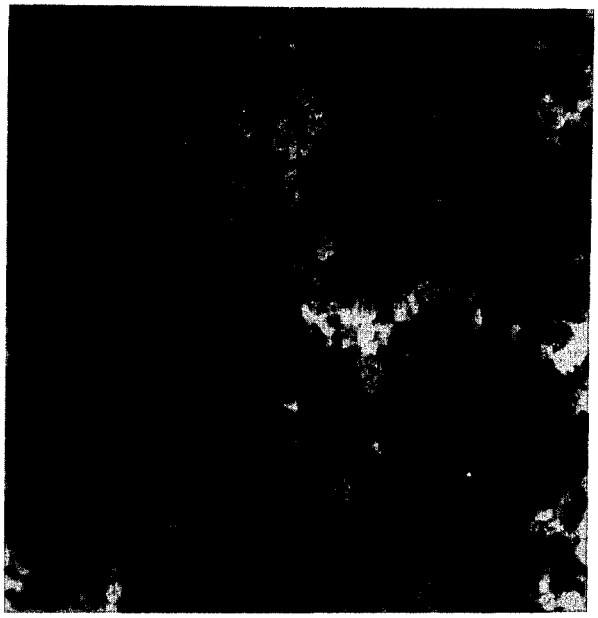
FIG. 3 is a scanning electron micrograph (10,000 X) of fine particles of silver.

Fine silver particles were produced in the same way as in Example 1 except that silver was used instead of iron. The results are shown in Table 3, and a scanning electron micrograph (10,000 X) of the fine silver particles obtained in Run No. 8 is shown in FIG. 3.

TABLE 3

| Run No. | Atmosphere | Rate of generating fine metal particles (g/hr) | Size of the fine particles (microns) | Rate of generating fine particles by the evaporating method |
|---|---|---|---|---|
| 7 | 25% $H_2$—Ar | 90 | less than | 42 g/hr |
| 8 | 31% $H_2$—Ar | 110 | 1 | (1,500 K) |

EXAMPLE 4

Fine aluminum particles were produced in the same way as in Example 1 except that aluminum was used instead of iron. The results are shown in Table 4.

TABLE 4

| Run No. | Atmosphere | Rate of generating fine metal particles (g/hr) | Size of the fine particles (microns) | Rate of generating fine particles by the evaporating method |
|---|---|---|---|---|
| 9 | 25% $H_2$—Ar | 9 | less than | 0.04 g/hr |
| 10 | 31% $H_2$—Ar | 35 | 5 | (1,300 K) |

EXAMPLE 5

Figure 4:
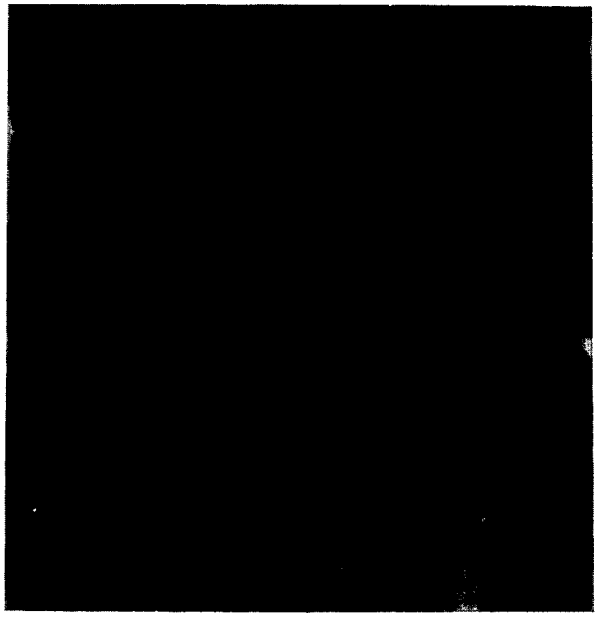
FIG. 4 is a scanning electron micrograph (10,000 X) of fine particles of titanium.

Fine titanium particles were produced in the same way as in Example 1 except that titanium was used instead of iron. The results are shown in Table 5, and a scanning electron micrograph (10,000 X) of the resulting fine titanium particles is shown in FIG. 4.

TABLE 5

| Run No. | Atmosphere | Rate of generating fine metal particles (g/hr) | Size of the fine particles (microns) | Rate of generating fine particles by the evaporating method |
|---|---|---|---|---|
| 11 | 50% $H_2$—Ar | 8–10 | less than 2 | 0.3 g/hr (2,000 K) |

EXAMPLE 6

Fine tantalum particles were produced in the same way as in Example 1 except that tantalum was used instead of iron. The results are shown in Table 6.

TABLE 6

| Run No. | Atmosphere | Rate of generating fine metal particles (g/hr) | Size of the fine particles (microns) | Rate of generating fine particles by the evaporating method |
|---|---|---|---|---|
| 12 | 50% $H_2$—Ar | 7 | less than | 0.5 g/hr |
| 13 | 75% $H_2$—Ar | 10 | 1 | (3,330 K) |

EXAMPLE 7

Figure 5:
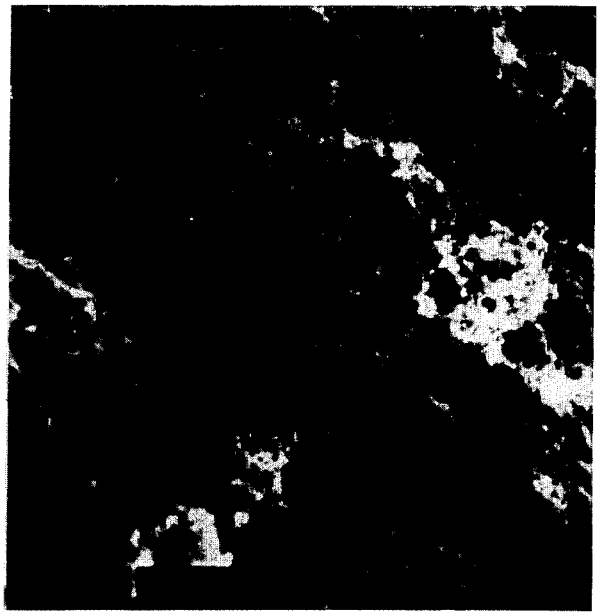
FIG. 5 is a scanning electron micrograph (10,000 X) of fine particles of a 14% Ni-Fe alloy.

Fine Ni-Fe alloy particles were produced in the same way as in Example 1 except that a 14% Ni-Fe alloy was used instead of iron. The results are shown in Table 7, and a scanning electron micrograph (10,000 X) of the resulting fine Ni-Fe alloy particles is shown in FIG. 5.

TABLE 7

| Run No. | Atmosphere | Rate of generating fine metal particles (g/hr) | Size of the fine particles (microns) |
|---|---|---|---|
| 14 | 50% $H_2$—Ar | 50–70 | less than 1 |

EXAMPLE 8

Figure 6:
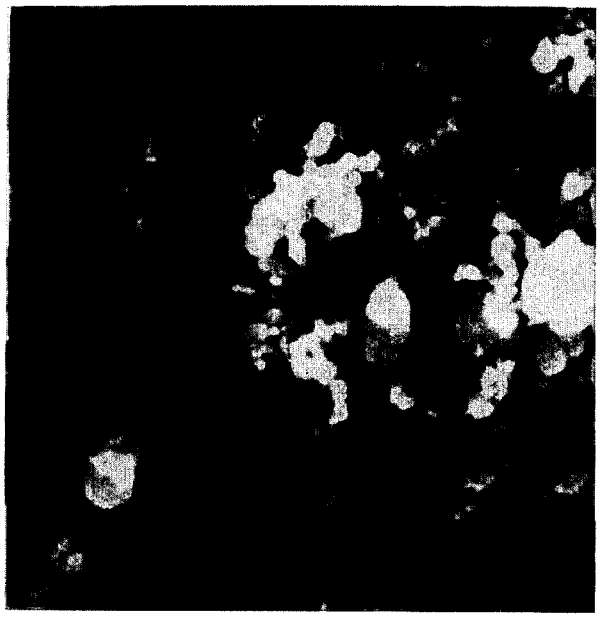
FIG. 6 is a scanning electron micrograph (20,000 X) of fine particles of a 50% Ti-Ni alloy.

Fine Ti-Ni alloy particles were produced in the same way as in Example 1 except that a 50% Ti-Ni alloy was used instead of iron. The results are shown in Table 8, and an electron scanning micrograph (20,000 X) of the resulting fine Ti-Ni alloy particles is shown in FIG. 6.

TABLE 8

| Run No. | Atmosphere | Rate of generating fine metal particles (g/hr) | Size of the fine particles (microns) |
|---|---|---|---|
| 15 | 50% $H_2$—Ar | 30–50 | less than 1 |

EXAMPLE 9

Figure 7:
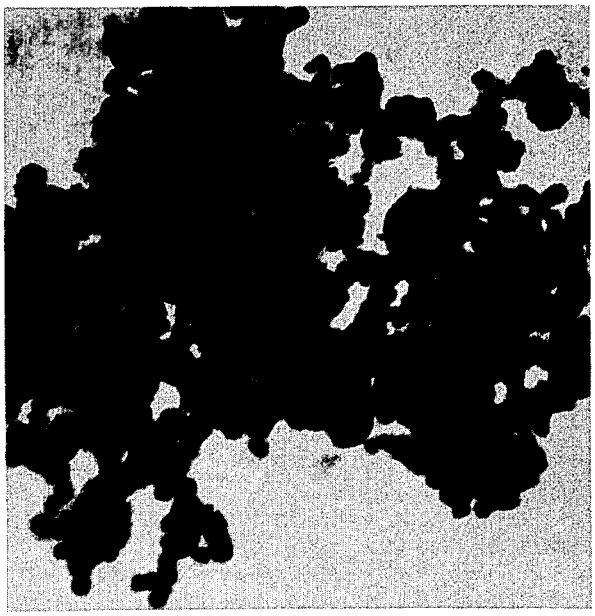
FIG. 7 is a electron micrograph (50,000 X) of fine particles of niobium.

Fine niobium particles were produced in the same way as in Example 1 except that niobium was used instead of iron. The results are shown in Table 9. A transmission electron micrograph (50,000 X) ×4 of the resulting fine niobium particles is shown in FIG. 7.

TABLE 9

| Run No. | Atmosphere | Rate of generating fine metal particles (g/hr) | Size of the fine particles (microns) | Rate of generating fine particles by the evaporating method |
|---|---|---|---|---|
| 16 | 80% $H_2$—Ar | 10 | less than 1 | 0.4 g/hr (2,930 K) |

The above description shows that the process of this invention can produce fine particles of metals having a diameter of less than 10 microns, even under 1 atmosphere, with an efficiency several times to several tens of times as high as that achieved by the vacuum evaporating method.

What we claim is:

1. A process for producing solid particles of a metal or alloy, comprising:

a. directing a stream of activated hydrogen gas or a mixture of at least 20 percent by volume of activated hydrogen gas and up to 80 percent by volume of at least one gas selected from the group consisting of argon and helium, onto a mass of molten metal or alloy to subdivide said mass into particles of said metal or alloy having a diameter of less than 5 microns, and b. cooling and collecting said particles.

2. The process of claim 1 wherein the activated hydrogen gas is generated by heating hydrogen by means of a high-temperature plasma.

3. The process of claim 1 wherein the activated hydrogen gas is generated by heating hydrogen by means of a low-temperature plasma.

4. The process of claim 1, further comprising:

melting said metal or alloy by an arc discharge in a closed chamber having a gas feed port and a gas discharge port, introducing hydrogen gas into said closed chamber through said gas feed port to make contact with the arc and with said mass of molten metal or alloy, and drawing off said hydrogen gas from said closed chamber to carry away said particles of metal or alloy with said hydrogen gas from said closed chamber.

* * * * *